US006576059B2

(12) United States Patent
Burgard

(10) Patent No.: US 6,576,059 B2
(45) Date of Patent: Jun. 10, 2003

(54) CHAMBERED DOCTOR BLADE SYSTEM FOR WATER-BASED AND UV-BASED COATINGS

(75) Inventor: Robert L. Burgard, Auburn, CA (US)

(73) Assignee: Harris & Bruno Company, Inc., Roseville, CA (US)

( * ) Notice: Subject to any disclaimer, the term of this patent is extended or adjusted under 35 U.S.C. 154(b) by 38 days.

(21) Appl. No.: 09/938,927

(22) Filed: Aug. 27, 2001

(65) Prior Publication Data

US 2002/0023587 A1 Feb. 28, 2002

Related U.S. Application Data

(63) Continuation-in-part of application No. 09/444,666, filed on Nov. 22, 1999, now Pat. No. 6,383,296.

(51) Int. Cl.[7] ..... B05C 1/08

(52) U.S. Cl. ..... 118/683; 118/684; 118/696; 118/712; 118/46; 118/602; 118/203; 118/259; 118/261; 118/413

(58) Field of Search ..... 118/683, 684, 118/696, 712, 46, 602, 203, 259, 413, 261; 101/350.1, 350.5, 366, 425, 483

(56) References Cited

U.S. PATENT DOCUMENTS 3,974,768 A * 8/1976 Grobman ..... 101/366
4,066,014 A * 1/1978 VAN Haaften ..... 101/157
4,527,479 A * 7/1985 Dahlgren et al. ..... 101/450.1
4,534,291 A * 8/1985 Sabota et al. ..... 101/483
4,643,124 A * 2/1987 Switall ..... 118/259
4,737,378 A * 4/1988 Narita et al. ..... 427/8
4,821,672 A * 4/1989 Bruno ..... 118/261
4,822,647 A * 4/1989 Nozaki et al. ..... 427/421
5,003,876 A * 4/1991 Harrison et al. ..... 101/350.5
5,005,478 A * 4/1991 Goldberg et al. ..... 101/425
5,010,817 A * 4/1991 Grosshauser ..... 101/350.1
5,054,392 A * 10/1991 Greenwood ..... 101/142
5,103,730 A * 4/1992 Sarda ..... 101/425
5,207,159 A * 5/1993 DeMoore et al. ..... 101/350.1
5,213,044 A * 5/1993 Elia et al. ..... 101/483
5,273,583 A * 12/1993 Langlois et al. ..... 118/665
5,323,705 A * 6/1994 Durrnagel ..... 101/424
5,330,576 A * 7/1994 Clauditz ..... 118/688
5,367,982 A * 11/1994 DeMoore et al. ..... 118/46
5,402,724 A * 4/1995 Yaeso et al. ..... 101/424
5,410,961 A * 5/1995 DeNicola et al. ..... 101/363
5,425,809 A * 6/1995 Person ..... 118/264
5,570,633 A * 11/1996 Schultz et al. ..... 101/182
5,683,508 A * 11/1997 Bleiler et al. ..... 118/46
5,816,163 A * 10/1998 Achelpohl et al. ..... 101/483
5,915,302 A * 6/1999 Baba et al. ..... 101/366
5,967,044 A * 10/1999 Marschke ..... 101/363
6,012,391 A * 1/2000 Weishew ..... 101/424
6,041,709 A * 3/2000 Wells et al. ..... 101/366
2002/0023561 A1 * 2/2002 Leimand ..... 101/366

* cited by examiner

*Primary Examiner*—Laura Edwards
(74) *Attorney, Agent, or Firm*—Harris Zimmerman

(57) ABSTRACT

A chambered doctor blade apparatus provides an automatic system for cleanup and replacement of coating substance, as well as operating a hydraulic head loading system that includes hydrostatic compensation, and integrates the head loading mechanism into the automated cleaning, flushing and replacement cycle. A programmable logic controller (PLC) is connected to a touch screen display that presents an interactive graphical user interface for control purposes. The PLC is programmed to carry out sequentially the required steps for cleaning, refilling, and running the chambered doctor blade assembly, and to alternate water-based and non-water-based coatings without necessitating removal of the doctor blade head from the transfer roller. Each coating run begins with a purge step in which a new coating material is pumped through the system to waste to remove any residual material from the previous coating run.

20 Claims, 7 Drawing Sheets

UV Cured Coatings
Process Steps

X=closed/off
O=open/on

| | Valve 135 | Pump Slow | Pump Med | Pump Fast | Valve 110 | Valve 123 | Valve 103 | Valve 104 | Valve 102 | Valve 59 | Valve 108 | Valve 107 | Valve 106 |
|---|---|---|---|---|---|---|---|---|---|---|---|---|---|
| Stop | X | X | X | X | X | O | X | X | X | X | X | X | X |
| Chamber Load | O | X | X | X | X | O | X | X | X | O | X | X | X |
| Coating Purge | O | X | O | X | X | X | X | X | O | O | O | X | X |
| Coating Fill | X | X | O | X | X | X | X | X | O | O | X | O | X |
| Coating Run | X | O | X | X | X | X | X | X | O | O | X | O | X |
| Coating Drain | O | X | O | X | X | O | X | X | O | O | X | O | X |
| Recirc. Wash 1 | X | X | O | X | X | X | O | X | X | O | X | X | O |
| Recirc. Wash 1-1 | O | X | O | X | X | X | O | X | X | O | X | X | O |
| Recirc. Drain 1 | O | X | X | O | X | X | O | X | X | O | X | X | O |
| Recirc. Wash 2 | X | X | X | O | X | X | O | X | X | O | X | X | O |
| Recirc. Wash 2-2 | O | X | X | O | X | X | O | X | X | O | X | X | O |
| Recirc. Drain 2 | O | X | X | O | X | O | O | X | X | O | X | X | O |
| Chamber Unload Delay | O | X | X | X | X | O | X | X | X | O | X | X | X |
| Chamber Unload | X | X | X | X | X | O | X | X | X | X | X | X | X |

FIG. 10

Water-Based Coatings Process Steps

X=closed/off
O=open/on

| | Valve 135 | Pump Slow | Pump Med | Pump Fast | Valve 110 | Valve 123 | Valve 103 | Valve 104 | Valve 102 | Valve 59 | Valve 108 | Valve 107 | Valve 106 |
|---|---|---|---|---|---|---|---|---|---|---|---|---|---|
| Stop | X | X | X | X | X | O | X | X | X | X | X | X | X |
| Chamber Load | O | X | X | X | X | O | X | X | X | O | X | X | X |
| Coating Purge | O | X | O | X | X | X | X | X | X | O | O | X | X |
| Coating Fill | X | X | O | X | X | X | X | X | O | O | X | O | X |
| Coating Run | X | O | X | X | X | X | X | X | O | O | X | O | X |
| Coating Drain | O | X | O | X | X | O | X | X | O | O | X | O | X |
| Water Rinse 1 | X | X | O | X | X | X | X | O | X | O | O | X | X |
| Water Rinse 1-1 | O | X | O | X | X | X | X | O | X | O | O | X | X |
| Water Drain 1 | O | X | X | O | X | X | O | X | X | O | O | X | X |
| Recirc. Wash 1 | X | X | X | O | X | X | O | X | X | O | O | X | O |
| Recirc. Wash 1-1 | O | X | X | O | X | X | O | X | X | O | X | X | O |
| Recirc. Drain 1 | O | X | X | O | X | O | O | X | X | O | X | X | O |
| Water Rinse 2 | X | X | X | O | X | X | X | O | X | O | O | X | X |
| Water Rinse 2-2 | O | X | X | O | X | X | X | O | X | O | O | X | X |
| Water Drain 2 | O | X | X | O | X | X | O | X | X | O | O | X | X |
| Chamber Unload Delay | O | X | X | X | X | O | X | X | X | O | X | X | X |
| Chamber Unload | X | X | X | X | X | O | X | X | X | X | X | X | X |

FIG. 11

CHAMBERED DOCTOR BLADE SYSTEM FOR WATER-BASED AND UV-BASED COATINGS

REFERENCE TO RELATED APPLICATION

This application is a continuation-in-part of application Ser. No. 09/444,666, filed Nov. 22, 1999, now U.S. Pat. No. 6,383,296, issued May 7, 2002.

BACKGROUND OF THE INVENTION

In the application of liquid substances to a moving web or successive sheets of material, it is considered well known in the art to apply the liquid using a rotating transfer roller, and to directly apply the liquid uniformly onto the roller by means of a doctor blade assembly. The doctor blade assembly generally includes a reservoir chamber extending the length of the transfer roller and in contact with the circumferential surface thereof, and a pair of doctor blades extending longitudinally on either side of the chamber. The doctor blades are angled obliquely toward the transfer roller surface, and serve both to seal the reservoir chamber to the roller and to form a uniform film of liquid on the roller transfer surface. The assembly also must include some means to seal the reservoir chamber at the ends of the roller, so that the liquid is not flung from the roller into the surroundings, and so that the liquid may be pumped through the reservoir during the transfer process. Such transfer systems are used in flexographic and gravure printing, adhesive applicators in the paper converting industry, coating applicators in many different industrial processes, and the like. An exemplary system is described in U.S. Pat. No. 4,821,672, issued to Nick Bruno on Apr. 18, 1989.

Chambered doctor blade devices are generally employed with large printing presses or paper converting machines, either of which comprising a substantial capital investment. The forces of economics dictate that these machines be used productively to the greatest extent possible. Any downtime is considered to be a diminishment of return on investment, to be avoided whenever possible.

It is often necessary to change the ink or coating compound that is applied by the chambered doctor blade apparatus, due to color change or alteration of the machine setup. Typically, the ink reservoir, supply lines, valves, and inking chamber must be drained, flushed, cleaned, and resupplied with a new ink or coating compound. The time spent in carrying out these tasks comprises machine downtime, a loss in productivity. Automated systems for supplying a doctor blade chamber are known in the prior art, and include some draining and flushing features. These systems also enable the transfer roller to be cleaned by the doctor blade assembly as it cleans itself, shrinking the labor requirement of the cleaning and refilling process. It is highly desirable for an automated system to drain, flush, and clean all of the supply lines and fittings, whereby contamination from a former machine setup is removed before a new setup is created. One such system, depicted in U.S. Pat. No. 5,683,508 describes a doctor blade coating system which purports to automate the wash and clean cycle in addition to supplying the coating chamber. However, this system typifies the prior art in that it does not route the washing and flushing liquids through the same lines and fittings that deliver the ink or coating substances. As a result, some components such as the supply pump and supply lines, and the associated connectors are not cleaned before a new ink color or coating is introduced into the system.

It is also known that chambered doctor blade devices rely on doctor blades impinging on a transfer (anilox) roller to form a smooth and uniform film of ink or coating substance on the roller. The doctor blades are required to present a highly linear edge that impinges on the transfer roller with a force that is very uniform along the entire length of the blades (which can extend over 170 inches). Due to vibration and wear, the doctor blade edges may develop areas where the contact force varies along the length thereof, causing uneven distribution of the ink or coating film on the transfer roller.

There is known in the prior art at least one system for urging the doctor blades toward the transfer roller that employs hydraulic cylinders spaced along the apparatus to distribute the loading force therealong. Moreover, the hydraulic system is energized by pneumatic pressure, which provides hydrostatic compensation in the hydraulic circuit that enables each hydraulic piston to advance or retract as necessary to maintain a constant loading pressure against the transfer roller. In addition, the system provides a restricted flow orifice at each hydraulic cylinder, so that each cylinder may resist rapid motion (vibration and the like) while enabling slower adjustability in response to wear conditions. Although this superior doctor blade loading system has been available in the prior art, it has not been integrated into an automatic cleanup and ink and coating replacement system.

SUMMARY OF THE INVENTION

The present invention generally comprises a chambered doctor blade apparatus that provides automatic system for cleanup and replacement of ink or coating substance. The automatic system also operates a hydraulic head loading system that includes hydrostatic compensation, and integrates the head loading mechanism into the automated cleaning, flushing and replacement cycle. (Hereinafter, reference will be made to the use of ink in a printing process, but it is understood that any coating substance is encompassed by this discussion.)

In one aspect, the invention includes a chambered doctor blade assembly having a supply line connected to one end and a return line connected to the other end. A return pump has an intake connected to the return line, and an output connected through a return valve to a changeable ink reservoir. A supply pump has an output connected to the chamber supply line, and an intake connected through a supply valve to the ink reservoir. The supply pump intake line is also connected to a vent valve, and to a first wash valve that is connected to a first wash tank. The line from the supply valve at the ink reservoir is connected through a first pair of valves to a main water reservoir and a second wash tank. The line from the return valve at the ink reservoir is connected through a second pair of valves to the second wash tank and to a waste discharge outlet. Actuation of these valves and pumps in various combinations and sequences enables all of the valves, fittings, pumps, the doctor blade chamber, and the anilox roller to be drained, flushed, cleaned, flushed, and recharged with fresh ink.

In a further aspect of the invention, the system includes an automated system for controlling the valves and pumps enumerated above to carry out the cleaning and recharging functions also described above. The automated system includes a programmable logic controller (PLC) connected through a display driver to a touch screen display that depicts system conditions and presents an interactive graphical user interface for control purposes. The PLC is connected to a non-volatile memory that stores programming and values to carry out sequentially the required steps for cleaning, refilling, and running the chambered doctor blade assembly. The PLC is connected to each of the pumps and valves, and to the head loading valve of a hydrostatically compensated hydraulic head loading system.

The hydrostatically compensated hydraulic head loading system includes a hollow pivot tube extending parallel to the length of the doctor blade chamber and mounted on a coaxial pivot shaft. A plurality of hydraulic cylinders, each having a rolling diaphragm piston mounted therein, are spaced along the back panel of the doctor blade chamber, with each piston secured to the back panel. Each cylinder is rigidly secured to the pivot tube, whereby the pivot tube supports the hydraulic cylinders and the doctor blade assembly. A handle secured to the pivot tube permits the assembly to be rotated to bring the doctor blades into and out of engagement with the adjacent anilox roller.

The pivot tube also serves as a manifold to supply hydraulic fluid to the cylinders. An hydraulic supply reservoir includes a head space that is connected through a head loading valve to a source of selectively controlled pneumatic pressure, and the fluid is connected to supply the interior of the hollow pivot tube. An hydraulic supply line extends from each hydraulic cylinder to an adjacent fitting extending from the pivot tube to pressurize the cylinders whenever the head loading valve is activated. The pneumatic loading of the hydraulic fluid supplies a constant and uniform pressure to all the cylinders, and further enables the hydraulic fluid to flow bidirectionally and allows each hydraulic piston to advance or retract as necessary to maintain a constant loading pressure against the transfer roller. In addition, the system provides a restricted flow orifice at each hydraulic cylinder, so that each cylinder may resist rapid motion (vibration and the like) while enabling low velocity adjustability in response to wear conditions.

BRIEF DESCRIPTION OF THE DRAWING

FIG. 10 is a chart depicting the operational status of each active mechanical component of the automated system in each step required for filling, running, and cleaning the chambered doctor blade assembly using non-water-based coatings.

FIG. 11 is a chart depicting the operational status of each active mechanical component of the automated system in each step required for filling, running, and cleaning the chambered doctor blade assembly using water-based coatings.

DESCRIPTION OF THE PREFERRED EMBODIMENT

Figure 6:
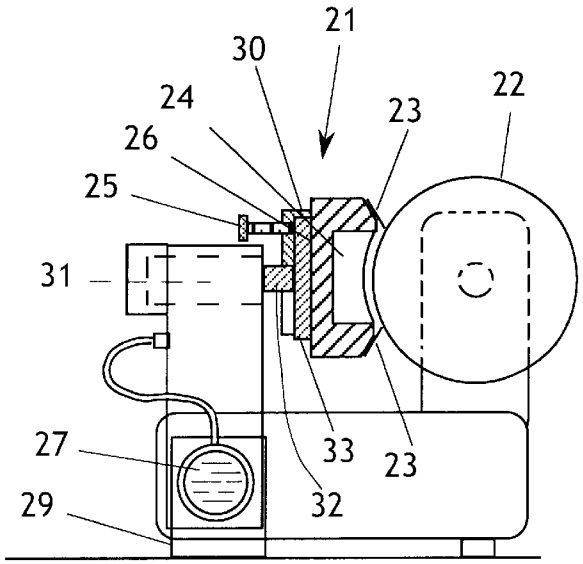
FIG. 6 is a side elevation of the doctor blade assembly and the head loading system of the invention.

The present invention generally comprises a chambered doctor blade apparatus that includes an automatic system for cleanup and replacement of ink or coating substance. With regard to FIGS. 1, 2, and 6, the applicator portion of the invention includes a chambered doctor blade assembly 21 extending parallel to a transfer roller 22 (anilox or equivalent) that engages a printing press, coating applicator, or the like. The assembly 21 includes a longitudinally extending cavity, or chamber 24, and a pair of doctor blades 23 that engage the surface of the transfer roller and form a uniform thin fluid film thereon. The chamber 24 is formed by a channel-like structure having a central web 26 and side walls extending therefrom in parallel, spaced apart relationship.

A hollow pivot tube 27 extends parallel to the central web 26 for substantially the entire length thereof, and is mounted on coaxial pivot shafts 28 which are rotatably supported at opposed ends. A plurality of hydraulic cylinders 31 are mounted rigidly on the pivot tube 27 and spaced longitudinally therealong. Each piston rod 32 of the cylinders 31 is secured to a mounting disk 33, which in turn is slidably received in a receptacle in a bracket 30 secured to the back surface of the central web 26. A lock-down screw 25 secures the disk 33 in the bracket 30. Thus the entire structure 21 is supported by the piston rods 32, which in turn are supported on the pivot tube 27. A handle 34 is secured to the tube 27 to enable rotation of the tube to bring the chambered doctor blade assembly 21 into and out of engagement with the transfer roller 22. At least one shaft lock 36 is also provided to lock the pivot tube 27 and pivot shafts 28 at a fixed angular orientation to secure the apparatus 21 in an engaged or disengaged disposition.

It may be appreciated that the entire head assembly 21 may be removed quickly and easily by loosening all of the screws 25, and sliding the brackets 30 off of the disks 33. Another head assembly 21 may be substituted by reversing this process.

The pivot tube 27 further serves as a manifold to supply low pressure hydraulic fluid to the cylinders 31. An hydraulic supply reservoir 37 is disposed adjacent to the tube 27, and includes a supply line 38 that delivers hydraulic fluid from the reservoir to the interior of the pivot tube 27. The reservoir provides head space above the fluid charge therein, and a pneumatic line 39 connects the head space through a head loading valve to a pressurized gas source having a selectively adjustable pressure in a generally low pressure range. A plurality of supply lines 41 extend from a fitting on the pivot tube 27 to a respective one of the hydraulic cylinders 31. Thus the hydraulic fluid supplied through the interior of the pivot tube 27 to each cylinder is under a constant and uniform pressure, and is free to flow bidirectionally between the reservoir, pivot tube, and cylinders. This feature enables all pistons to exert the same force on the central web of the doctor blade assembly, while each piston is able to extend a variable amount until it meets sufficient mechanical resistance that is equal and opposite to the hydraulic force of the piston. This attribute allows the doctor blade assembly to self-compensate for wear, expansion, and other physical variables in the relationship between the doctor blade assembly and the transfer roller.

Figure 3:
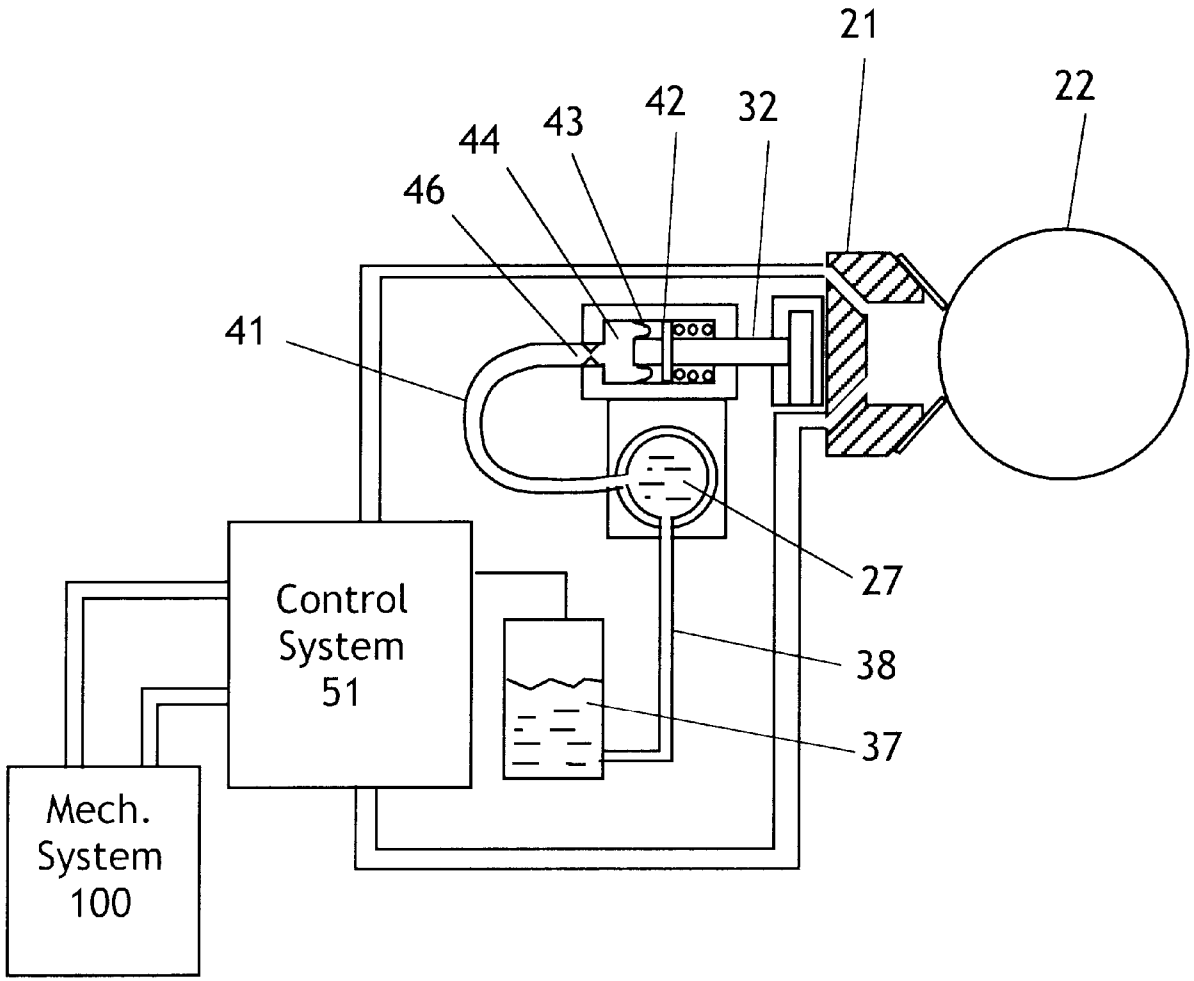
FIG. 3 is a schematic view of the hydrostatically compensated hydraulic head loading system combined with the automatic cleaning and recharging system of the invention.

With regard to FIG. 3, each cylinder 31 includes a piston 42 connected to the piston rod 32, the piston 42 having a rolling diaphragm seal 43. The driving chamber 44 of the cylinder 31 is connected through a restricted orifice 46 to the input of the supply line 41. The restricted orifice 46 prevents the piston 42 from undergoing any high velocity translation, thereby minimizing any response to rapid motion of the doctor blade assembly, such as vibration and the like. On the other hand, the restricted orifice does not inhibit low velocity translation of the piston 42, whereby the system provides self-compensating adjustment to wear and other long-term variables.

Figure 4:
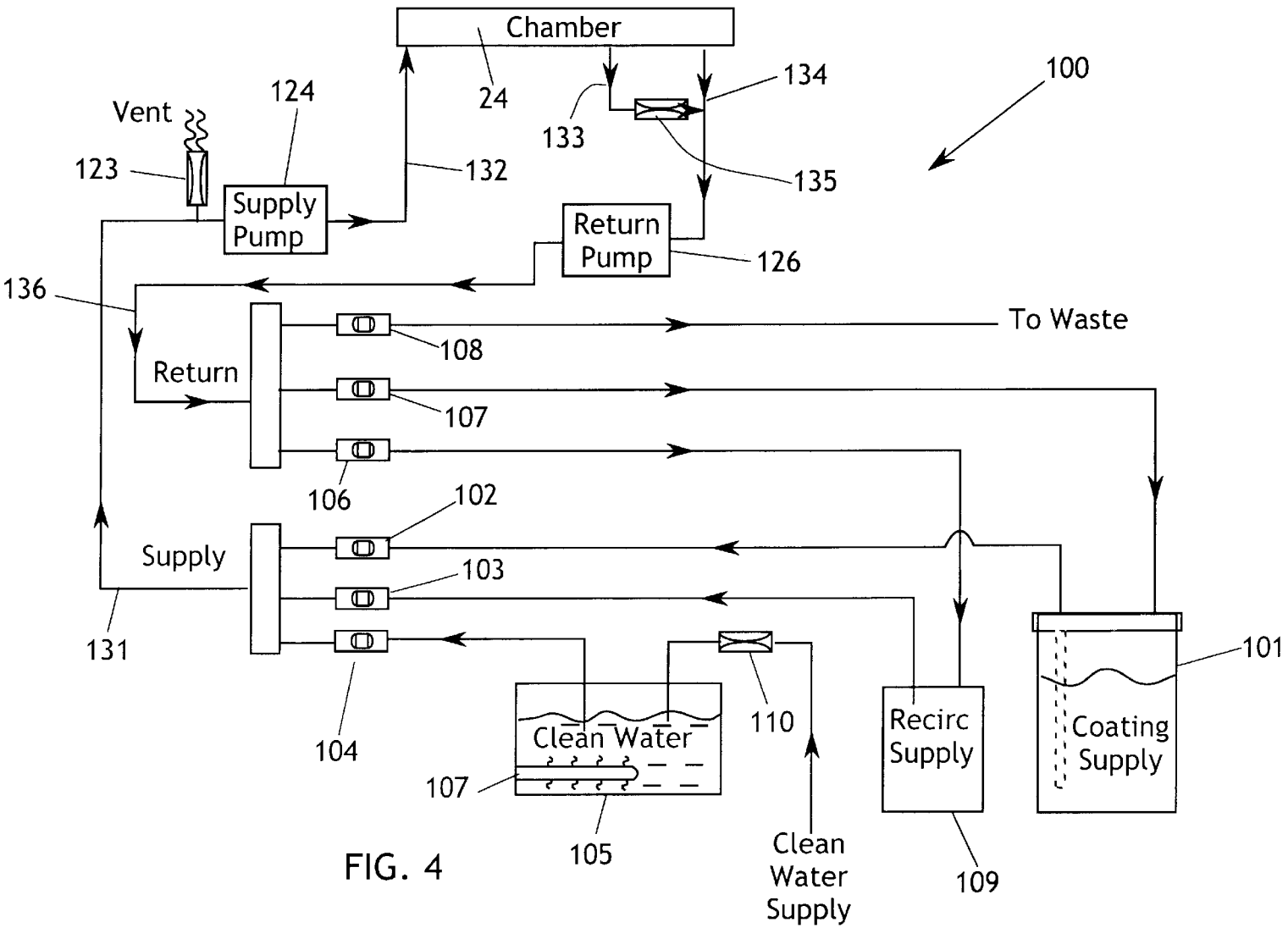
FIG. 4 is a schematic representation of the active mechanical components of the automatic cleaning and recharging system of the invention.

With regard to FIG. 4, the mechanical components 100 of the automated cleaning, filling, and operating system include an interchangeable coating supply reservoir 101. A draw tube in the reservoir 101 feeds a coating substance (ink or UV coating or any other liquid) through a supply valve 102 to a supply line 131. The supply line 131 extends to the intake port of supply pump 124, the output of which is connected through line 132 to the doctor blade chamber. The system also includes a heated clean water reservoir 105 that is connected through supply valve 104 to the supply line 131. The reservoir 105 is maintained at a fill level by a valve 110 connected to a clean water supply, using a level detector (as is known in the art) to operate the valve 108. A heater 107 in the reservoir 105 heats and maintains the water at a preset temperature, and is thermostatically controlled.

In addition, the system includes a recirculation reservoir 109 that has an outlet connected through valve 103 to the supply line 131. The inlet to reservoir 109 is connected through valve 106 to the return line 136. A valve 107 connects the return line 136 to the inlet of coating supply reservoir 101, and a valve 108 connects the return line 136 to a waste discharge receptor.

Figure 5:
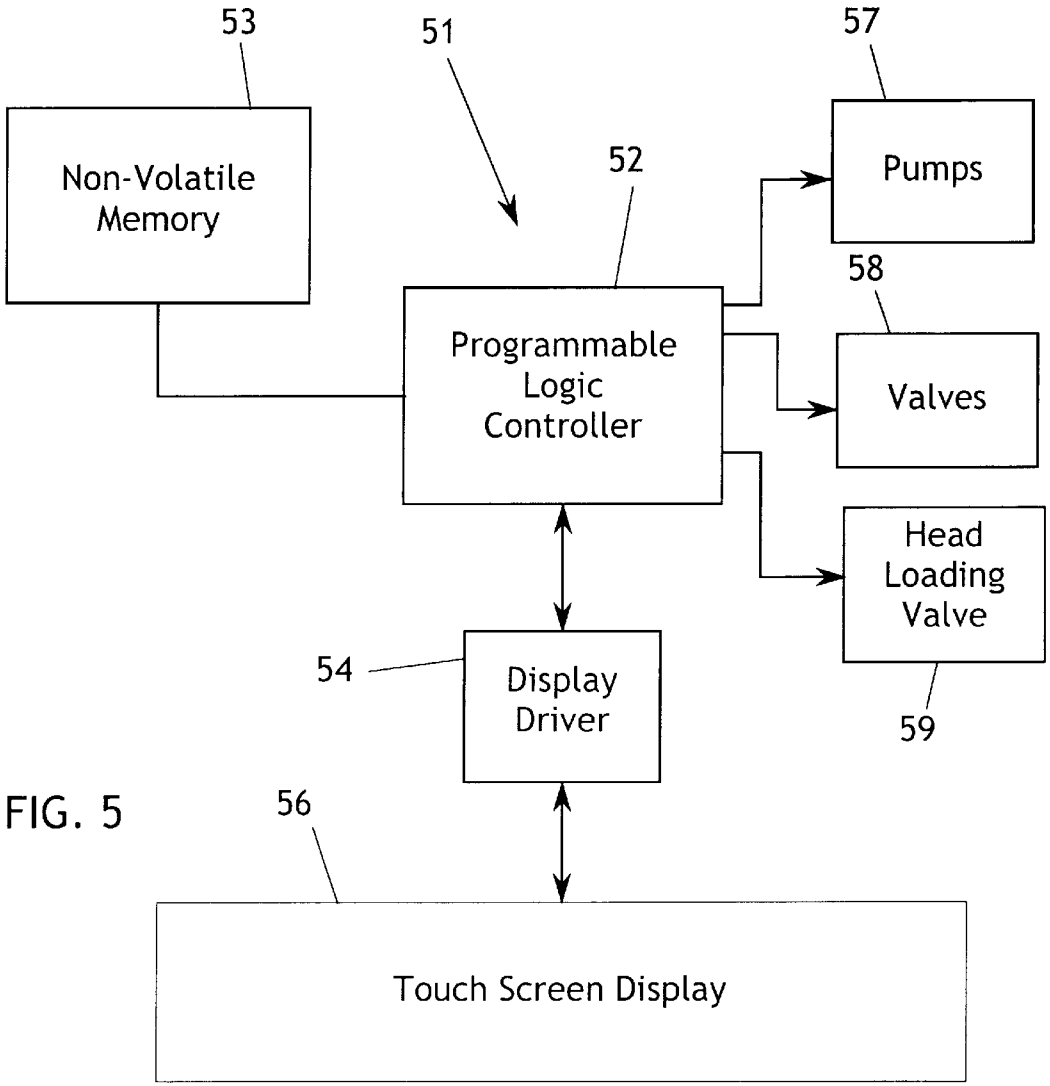
FIG. 5 is a functional block diagram representation of the active electronic components of the automatic cleaning and recharging system of the invention.
Figure 8:
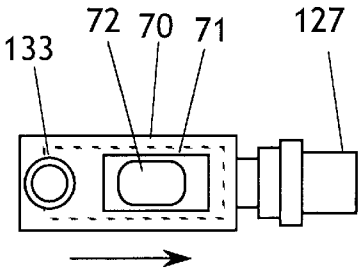
FIG. 8 is an enlarged top view of the drain reservoir valve of the automatic cleaning and recharging system of the invention.

With reference to FIG. 5, the invention further includes an automatic system 51 for operating the valves and pumps described above to carry out all steps required for filling, running, and cleaning the chambered doctor blade assembly. The automated system 51 includes a programmable logic controller (PLC) 52 connected through a display driver 54 to a touch screen display 56. The display 56 serves as a graphical user interface by presenting system functions that are selectable by a user. The display 56 further acts as an input device by enabling the user to tap the portion of a screen display that corresponds to a chosen function, and the touch screen feeds the selection information back to the PLC 52. In addition, a non-volatile memory 53 that stores programming instructions and data values is connected to the PLC 52 to provide the proper screen displays and carry out the functions and choices portrayed by the screen displays.

The PLC 52 is also connected to operate the system pumps 57 (corresponding to the supply pump 124 and return pump 126 of FIG. 4), and the system valves (corresponding to the valves 102–104, 106–108, 110, 123, and 135). The PLC is also connected to operate the head loading valve 59 which, as described previously, controls the application of pneumatic pressure to the hydraulic fluid reservoir 37 that supplies the hydraulic cylinders 31 of the doctor blade mounting system. The PLC is further connected to the heater 107 and to appropriate sensors and limit switches that a prudent individual skilled in the art would include for safety and smooth operations. The stored programming of the PLC 52 is written to carry our the operating functions of the doctor blade system, including, but not limited to, the functions described in FIG. 10 (for UV cured coatings) and FIG. 11 (for water-based coatings). All of these functions may be carried out while the chambered doctor blade assembly 21 is engaged with the roller 22, whereby the roller is cleaned, washed, and coated at the same time as the remainder of the system undergoes these processes. As a result, the head loading valve 59 is On for all of the procedures except the Stop and Unload condition.

Figure 9:
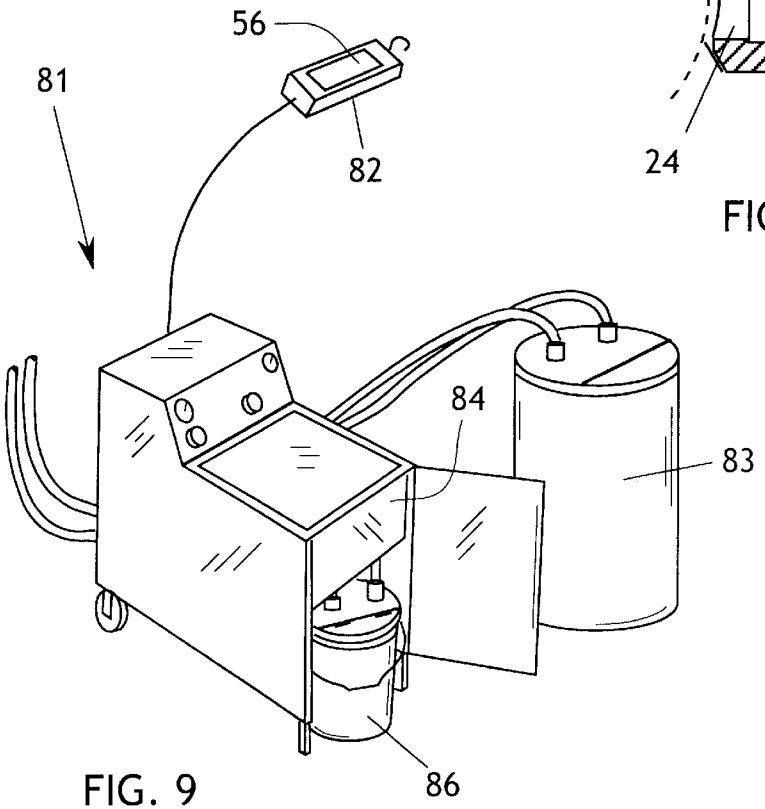
FIG. 9 is a perspective view the console of the automatic cleaning and recharging system of the invention.

The mechanical components depicted in FIG. 4 and the electronic system of FIG. 5 may be incorporated into a small, portable console 81, as shown in FIG. 9. The console 81 is supported on casters, and includes a tank 84 that comprises the heated water reservoir 105, and a space for a removable container 86 that comprises the recirculation supply reservoir 109. The coating supply reservoir 101 is maintained in separate tank 83 that is connected through removable lines to the console 81. Note that the tank 83 is easily removed and replaced (swapped) to change the coating material that is applied by the system. A significant advantage of this system is that UV curable coatings (typically not compatible with water as a solvent) and water-based coatings may be alternated and are automatically accommodated, as described below.

The touch screen display 56 is supported in a handheld remote control 82 connected by cable to the console 81, whereby the user may select a desired function for the system, and the function is carried out by the electronic system depicted in FIG. 5. The desired function may include a plurality of the procedures listed in FIGS. 10 and 11, carried out sequentially to effect a complete job change for the transfer roller; i.e., coating purge and drain, recirculate wash and drain, and, thereafter, coating fill and run.

Figure 1:
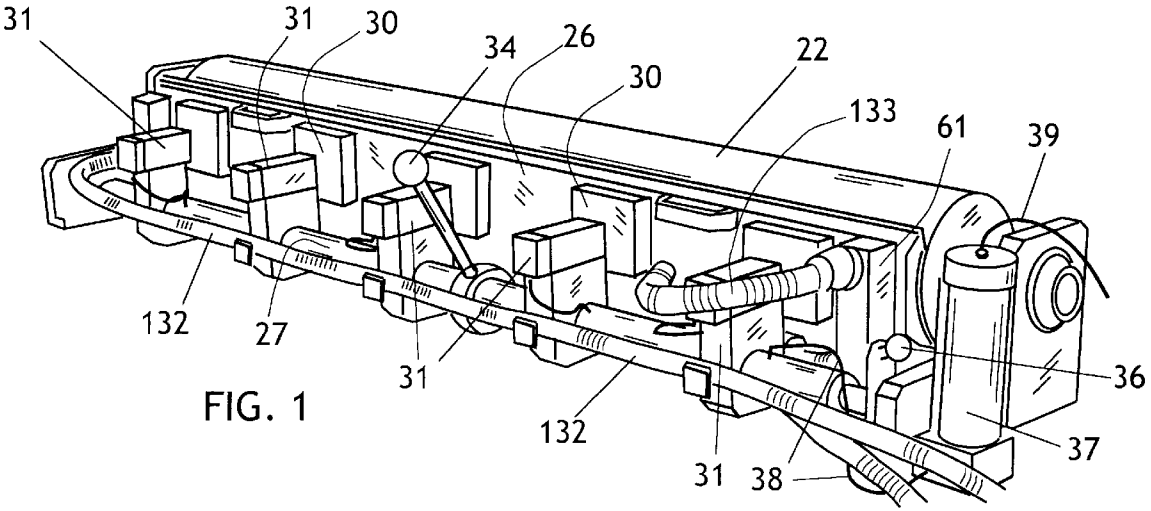
FIG. 1 is a perspective view of a chambered doctor blade mounted on a hydrostatically compensated hydraulic head loading assembly and connected to an automatic cleaning and refilling system.
Figure 2:
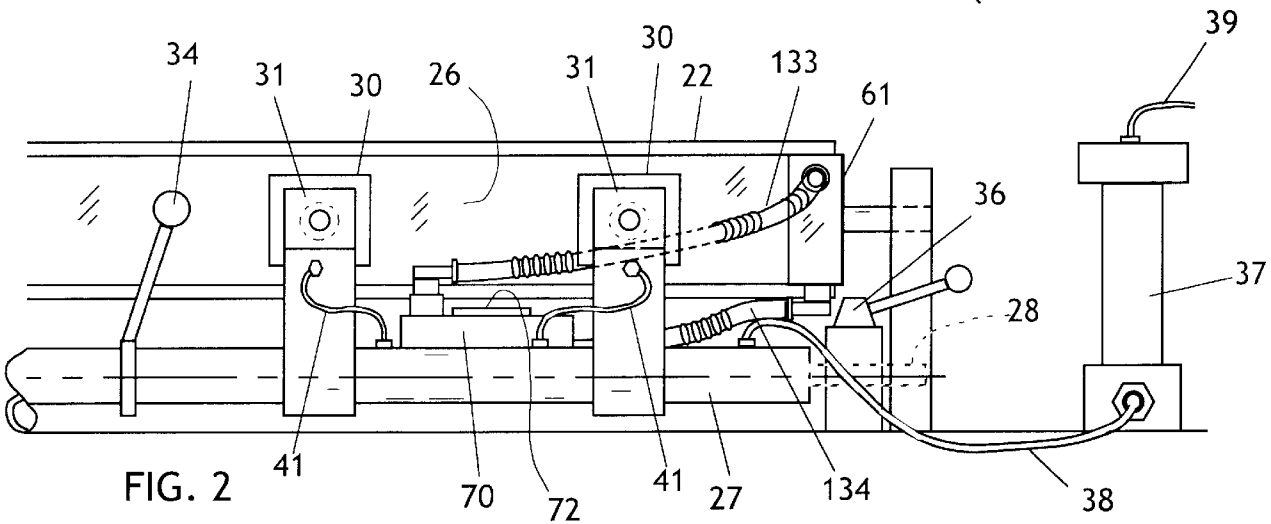
FIG. 2 is an enlarged partial plan elevation of the chambered doctor blade assembly as shown in FIG. 1.

The apparatus may further include an ambient port 71, as shown in FIGS. 1 and 2, that is disposed in a trough or channel 70 interposed between the return line 133 and the valve 127. It has been observed that the chambered doctor blade assembly, when running against the transfer roller, may develop a suction adhesion to the transfer roller. When the system is switched to a function such as draining a liquid from the chamber 24, the vacuum in the chamber may hamper complete pump-out of the liquid. To overcome this effect, the ambient port 71 includes a top opening 72 that is open to atmosphere, as shown in FIG. 9, to maintain the return line to atmospheric pressure and releases any vacuum suction effects. The return pump may be operated at a slightly greater rate than the supply pump to assure that the flow through channel does not overflow from opening 72. Note that the trough 70 may extend substantially the entire length of the doctor blade chamber.

A significant advantage of this system is the capability to go from a water-based coating to a UV based coating and back again with little effort. This is successfully completed by the use of the coating purge step, followed by chamber filling of a different coating material. Thus, for example, a run of water based coating followed by a water based wash and drain routine could result in some residual water based fluids in the lines, valves, and fittings of the system. A subsequent run of UV coating could become contaminated by residual water based fluids in the system. To overcome this problem, a new coating run always begins with a coating purge step, in which the new coating is briefly pumped through the system and discharged to waste, thereby sweeping away the residual water based fluids. Thereafter, the coating fill and run routines are free of contamination. The same is true when switching from a UV coating to a water based coating.

The initial screen prompts the operator to select either water based coating or UV coating. When this selection is made the system selects the wash up procedure that is required. This is done due to the fact that water should not be used to wash UV coatings. Thus, as shown in FIG. 10, none of the wash steps for UV coatings involve opening the valve 104 to admit water to the system; rather, the recirc. supply tank 109 holds a solvent or the like that is fed through valve 103 to provide the fluid for the washing functions.

After the initial type of coating is selected there are only two choices that need to be selected. Start Coat and Start Wash. All the functions happen automatically after these selections are made. When Start Coat is selected the following process steps occur:

Chamber Load: The chamber will load against the anilox roll and the coating purge process will start after a given amount of time.

Coating Purge: The supply pump pulls material from the supply container, pumps it up to the chamber and through the bottom of the chamber. It then flows into the trough or reservoir 70 and is pulled out of the trough 70 by means of the return pump which is then pumped to waste for the given amount of time.

Coating Fill: The chamber drain valve is then closed, allowing the chamber to fill.

Coating Run: The chamber drain valve remains closed and the pumps automatically slow down for the duration of the coating job, after which the operator will select the automatic wash up. The Run Speed can be adjusted at the console for different flow rates.

At this point the operator may select Start Wash and the following steps will automatically occur:

Coating Wash: The first step when Coating Wash is selected is Coating Drain. It stops the supply of coating to the chamber by means of opening a pump vent valve. It also opens the chamber drain valve allowing the coating to drain from the chamber into the trough or reservoir. It returns as much residual coating back to the coating supply container as is set as a timing function by the installer.

Warm Water Rinse: (This rinse is only enabled when 'water based' is selected on the touch screen) Water is drawn with the supply pump from the water reservoir up to the chamber, through the chamber with the chamber drain valve closed at first to fill the chamber then opened to flush the bottom of the chamber. All of this flows into the trough where the return pump draws the material and sends it to waste.

Water Drain: The supply pump vent valve opens, stopping the supply of water to the chamber and draining the system of the residual material. This mode is only enabled when water based is selected at the start of the process.

Recirculation Wash: This wash cycle is enabled with either water based selected or UV selected. It pulls recycled wash up material from the recirculation container by means of the supply pump, supplies it to the chamber with the chamber drain valve closed to fill the chamber then opens the valve to flush the bottom of the chamber, all of this flowing into the trough and returned to the recirculation container by means of the return pump. The difference between the Water based wash and the UV wash is the UV wash cycle uses only the recirculation container to supply cleaning material, as any fresh water would contaminate the UV material.

Recirculation Drain: This opens the supply pump vent valve stopping the supply of wash materials and allowing residual materials to be drained back into the recirculation tank.

Warm Water Rinse 2: This step pulls warm water from the warm water supply tank up to the chamber with the chamber drain valve closed at first and then opening. This mode is only enabled when water-based is selected at the start of the process.

Water Drain 2: This opens the supply pump vent valve which stops the flow of water to the chamber and drains the residual out of the systems and to waste.

Chamber Unload: At the end of the wash process the chamber is automatically unloaded.

It is significant to note that any residual wash fluid is purged from the system by the introduction of new coating material at the start of the subsequent coating run. The Coating Purge step uses the new coating material to sweep any residual wash fluid from the lines and valves, and this material all goes to waste. Thereafter, the coating fill and run stages are free of any wash fluid that may be solvent-incompatible.

Figure 7:
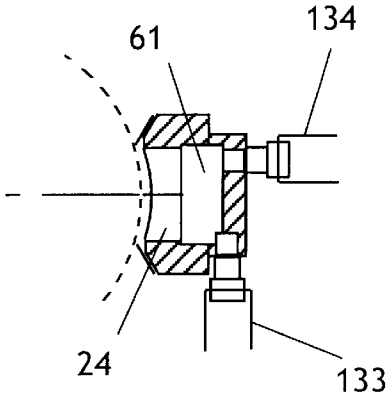
FIG. 7 is an enlarged cross-sectional detail of the doctor blade chamber connections to the return lines.

With regard to FIGS. 1, 2, and 7, the return lines 133 and 134 are connected to a manifold 61 secured to the return end of the chamber 24 of the doctor blade assembly 21. The connection of line 133 is used for circulating coating material during a system run cycle, as it provides the smoothest fluid flow through the chamber, and both the connections of lines 133 and 134 are used to drain liquid out of the chamber 24, due to the fact that the connection of line 133 is at the bottom of the chamber when the system remains engaged with a transfer roller, as shown in FIGS. 1 and 2. On the other hand, the connection of line 134 is lowermost when the doctor blade assembly 21 is rotated about the pivot tube 27 to disengage and move away from the transfer roller 22, and line 134 is used to drain the chamber in the disengaged disposition. In either case, liquid drained from the chamber first passes through the trough 70 at atmospheric pressure.

Thus the invention provides a system that automatically supplies coating material to a chambered doctor blade assembly, while also loading the doctor blade assembly against a transfer roller with a self-compensating, pressure balanced mounting apparatus. The system further carries out typical printer or industrial job changing tasks, such as draining, cleaning, and rinsing the doctor blade assembly and the transfer roller, and further refilling the system and supplying the system for a further production run, all automatically.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed:

1. An automated system for operating a chambered doctor blade assembly having a chamber adapted to supply a coating substance to a transfer roller, including:

at least one coating substance reservoir;

supply pump means for pumping the coating substance from said at least one reservoir to the doctor blade chamber;

return pump means for pumping the coating substance from the doctor blade chamber to said at least on reservoir;

valve means for controlling flow between said at least one reservoir, said supply pump means, and said return pump means;

means for rapidly switching between a water-based coating substance and a non-water-based coating substance;

electronic control means programmed for selectively operating said supply pump means, said return pump means, and said valve means to circulate said coating substance to said chamber.

2. The automated system for operating a chambered doctor blade assembly of claim 1, further including a chambered doctor blade assembly and a hydrostatic head loading system for releasably impinging the chambered doctor blade assembly on the transfer roller, said valve means connected also to control said hydraulic head loading system, and said electronic control means programmed also to operate said hydraulic head loading system.

3. The automated system for operating a chambered doctor blade assembly of claim 2, wherein said hydrostatic head loading system includes a plurality of hydraulic cylinders spaced along a length dimension of the doctor blade assembly, each hydraulic cylinder including a piston rod secured to the doctor blade assembly, and common manifold means for supplying hydraulic fluid to said hydraulic cylinders.

4. The automated system for operating a chambered doctor blade assembly of claim 3, further including pneumatic means for pressurizing said the hydraulic fluid in said common manifold means by direct impingement of pressurized gas.

5. The automated system for operating a chambered doctor blade assembly of claim 3, further including a plurality of restricted flow orifices, each interposed between said common manifold means and a respective one of said hydraulic cylinders.

6. The automated system for operating a chambered doctor blade assembly of claim 1, wherein said at least one coating substance reservoir includes a plurality of said coating substance reservoirs containing water-based and non-water-based coating substances, and means for selecting and swapping said reservoirs.

7. The automated system for operating a chambered doctor blade assembly of claim 6, wherein said means for rapidly switching between a water-based coating substance and a non-water-based coating substance includes a clean water supply, and a clean water supply valve to selectively conduct said clean water to said supply pump.

8. The automated system for operating a chambered doctor blade assembly of claim 7, wherein said clean water supply comprises a heated water supply.

9. The automated system for operating a chambered doctor blade assembly of claim 7, wherein said means for rapidly switching between a water-based coating substance and a non-water-based coating substance includes a non-water-based solvent supply, and a solvent supply valve to selectively conduct said solvent to said supply pump.

10. The automated system for operating a chambered doctor blade assembly of claim 9, wherein said solvent is contained in a recirculation supply tank.

11. The automated system for operating a chambered doctor blade assembly of claim 10, further including a solvent return valve for conducting said solvent from said return pump to said recirculation supply tank.

12. The automated system for operating a chambered doctor blade assembly of claim 11, wherein said electronic control means is programmed to run a water-based coating through said doctor blade assembly, and thereafter to drain the water-based coating and wash the system with clean water without necessitating removing said doctor blade assembly from the transfer roller, whereafter a coating reservoir containing a non-water-based coating substance may be connected and run through said system.

13. The automated system for operating a chambered doctor blade assembly of claim 11, wherein said electronic control means is programmed to run a non-water-based coating through said doctor blade assembly, and thereafter to drain the non-water-based coating and wash the system with solvent without necessitating removing said doctor blade assembly from the transfer roller, whereafter a coating reservoir containing a water-based coating substance may be connected and run through said system.

14. The automated system for operating a chambered doctor blade assembly of claim 1, further including a pair of drain lines connected between said return pump means and said chamber, said drain lines connected to the same end portion of said chamber and spaced apart to remove all liquid from said chamber.

15. The automated system for operating a chambered doctor blade assembly of claim 1, further including a trough interposed between said doctor blade chamber and said return pump means, and an ambient port in said trough to maintain said trough at atmospheric pressure.

16. The automated system for operating a chambered doctor blade assembly of claim 15, wherein said trough extends substantially the entire length of said chambered doctor blade assembly.

17. The automated system for operating a chambered doctor blade assembly of claim 1, further including a portable console for housing said supply pump means, said return pump means, said valve means, said electronic control means, and a heated water supply reservoir.

18. The automated system for operating a chambered doctor blade assembly of claim 17, wherein said portable console includes means for releasably connecting said at least one coating substance reservoir.

19. The automated system for operating a chambered doctor blade assembly of claim 1, wherein said electronic control means includes means for carrying out a coating purge step at the beginning of a new coating run.

20. The automated system for operating a chambered doctor blade assembly of claim 19, wherein said coating purge step includes pumping a new coating through the system to waste to remove any residual fluids from a previous coating run.

* * * * *